US006295683B1

(12) United States Patent
Lai et al.

(10) Patent No.: US 6,295,683 B1
(45) Date of Patent: Oct. 2, 2001

(54) EQUIPMENT FOR BRUSHING THE UNDERSIDE OF A SEMICONDUCTOR WAFER

(75) Inventors: Kuei-Si Lai; Shih-Hsun Chiou, both of Hsin-Chu; Kuo-Feng Huang, Chu-Pei; Ching-Chih Cheng, Hsin-Chu, all of (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/457,308

(22) Filed: Dec. 9, 1999

(51) Int. Cl.[7] ..... B08B 1/04
(52) U.S. Cl. ..... 15/77; 15/88.2
(58) Field of Search ..... 15/77, 88.2, 88.3, 15/102

(56) References Cited

U.S. PATENT DOCUMENTS 4,935,981 * 6/1990 Ohtani et al. ..... 15/88.2
5,361,449 * 11/1994 Akimoto .
5,485,644 * 1/1996 Shinbara et al. ..... 15/88.2
5,651,160 * 7/1997 Yonemizu et al. ..... 15/77
5,729,856 * 3/1998 Jang et al. ..... 15/88.1
5,985,039 * 11/1999 Yonemizu et al. ..... 15/77
6,058,544 * 5/2000 Motoda et al. ..... 15/77
6,079,073 * 6/2000 Maekawa ..... 15/77
6,115,867 * 9/2000 Nakashima et al. ..... 15/77
6,173,468 * 1/2001 Yonemizu ..... 15/77

FOREIGN PATENT DOCUMENTS 8-148450-A * 6/1996 (JP) .
8-241880-A * 9/1996 (JP) .
10-244458-A * 9/1998 (JP) .
10-335282-A * 12/1998 (JP) .
70875-A * 3/2000 (JP) .

* cited by examiner

*Primary Examiner*—Terrence R. Till
(74) *Attorney, Agent, or Firm*—Winston Hsu

(57) ABSTRACT

The present invention provides equipment for brushing the underside of a semiconductorwafer that is placed on a rotary wafer chuck. The equipment comprises a brush rod, a brush with a channel in it mounted at an end point of the brush rod, a nozzle for spraying water on the underside of the semiconductor wafer, and a driving device connected to the brush rod for driving the brush rod in a reciprocating motion. The wafer chuck rotates the semiconductor wafer and, simultaneously, water drives the blade and the brush to raise and rotate so as to spray water over the underside of the semiconductor wafer. The driving device drives the brush to brush the underside of the semiconductor wafer along a radial direction of the semiconductor wafer.

12 Claims, 7 Drawing Sheets

EQUIPMENT FOR BRUSHING THE UNDERSIDE OF A SEMICONDUCTOR WAFER

BACKGROUND OF THE INVENTION

1. Field of the Invention

The present invention relates to brushing equipment, and more particularly, to equipment for brushing the underside of a semiconductor wafer.

2. Description of the Prior Art

The development process plays an important role in semiconductor processing. During the development process, an exposed semiconductor wafer is placed in a developing solution to remove from the semiconductor wafer the photoresist that is not of the desired pattern, and then the developing solution is removed. However, the developing solution always flows to the underside of the semiconductor wafer and leaves a stain there. This affects the cleanliness and performance of the subsequent processes.

Please refer to FIG. 1. FIG. 1 is a schematic diagram of equipment 12 for brushing the underside of a semiconductor wafer 10 according to the prior art. The equipment 12 for brushing the underside of the semiconductor wafer 10 employs water to wash away the developing solution that flows to the underside of the semiconductor wafer 10. The equipment 12 comprises a rotary wafer chuck 14 for mounting and rotating the semiconductor wafer 10, and a nozzle 16 for spraying water onto the underside of the semiconductor wafer 10.

In using the equipment 12, the wafer chuck 14 rotates the semiconductor wafer 10 as the nozzle 16 sprays water onto the underside of the semiconductor wafer 10. A high-pressure water flow is used to wash away the developing solution from the underside of the semiconductor wafer 10. Generally, though, using only water is insufficient to clean the underside of the semiconductor wafer 10. Furthermore, if the material of the semiconductor wafer 10 is hydrophilic, a water mark will be formed on the underside of the semiconductor wafer 10, which also reduces the cleanliness and performance of the subsequent processes.

SUMMARY OF THE INVENTION

It is therefore a primary objective of the present invention to provide equipment for brushing the underside of a semiconductor wafer that can clean off developing solution flowing to the underside of the semiconductor wafer during the development process and so prevent the formation of water marks and stains on the underside of the semiconductor wafer.

In a preferred embodiment, the present invention provides equipment for brushing an underside of a semiconductor wafer. The equipment comprises a rotary wafer chuck for positioning the semiconductor wafer, a brush rod, a brush module mounted at an end point of the brush rod for spraying the underside of the semiconductor wafer with water, and a driving device connected to the brush rod for driving the brush rod in a reciprocating motion. When the wafer chuck rotates the semiconductor wafer, the brush module sprays the underside of the semiconductor wafer with water and the driving device drives the brush module to brush the underside of the semiconductor wafer along a radial direction of the semiconductor wafer.

It is an advantage of the present invention that the equipment comprises a nozzle for spraying water onto the underside of the semiconductor wafer, as well as a brush for brushing the underside of the semiconductor wafer. Hence, the equipment cleans off all of the developing solution remaining on the underside of the semiconductor wafer. Also, during brushing, the equipment rotates the semiconductor wafer and the driving device drives the brush to brush the underside of the semiconductor wafer along the radial direction of the semiconductor wafer. Consequently, contaminated areas on the underside of the semiconductor wafer are cleaned off.

This and other objectives of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
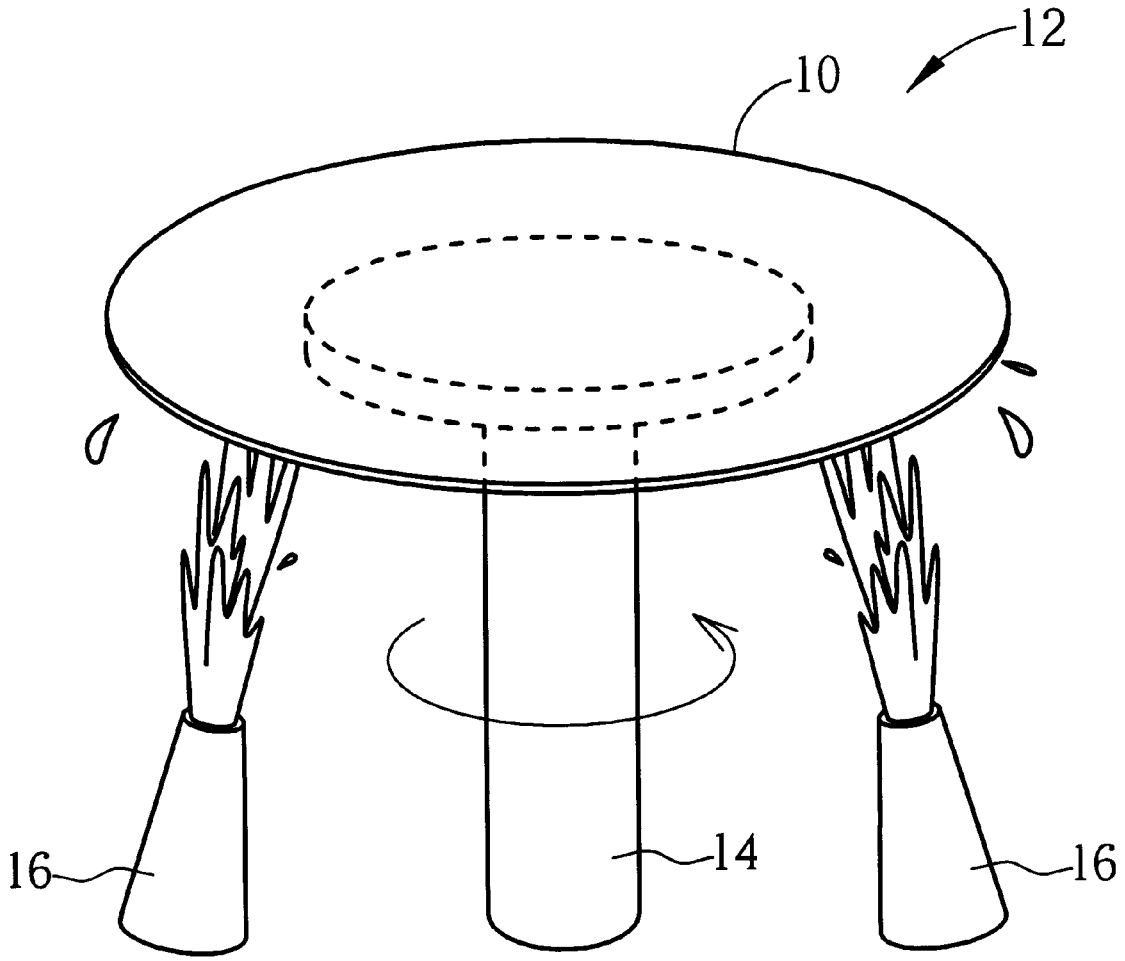
Fig. 1 Prior art
FIG. 1 is a schematic diagram of equipment for brushing the underside of a semiconductor wafer according to the prior art.
Figure 2:
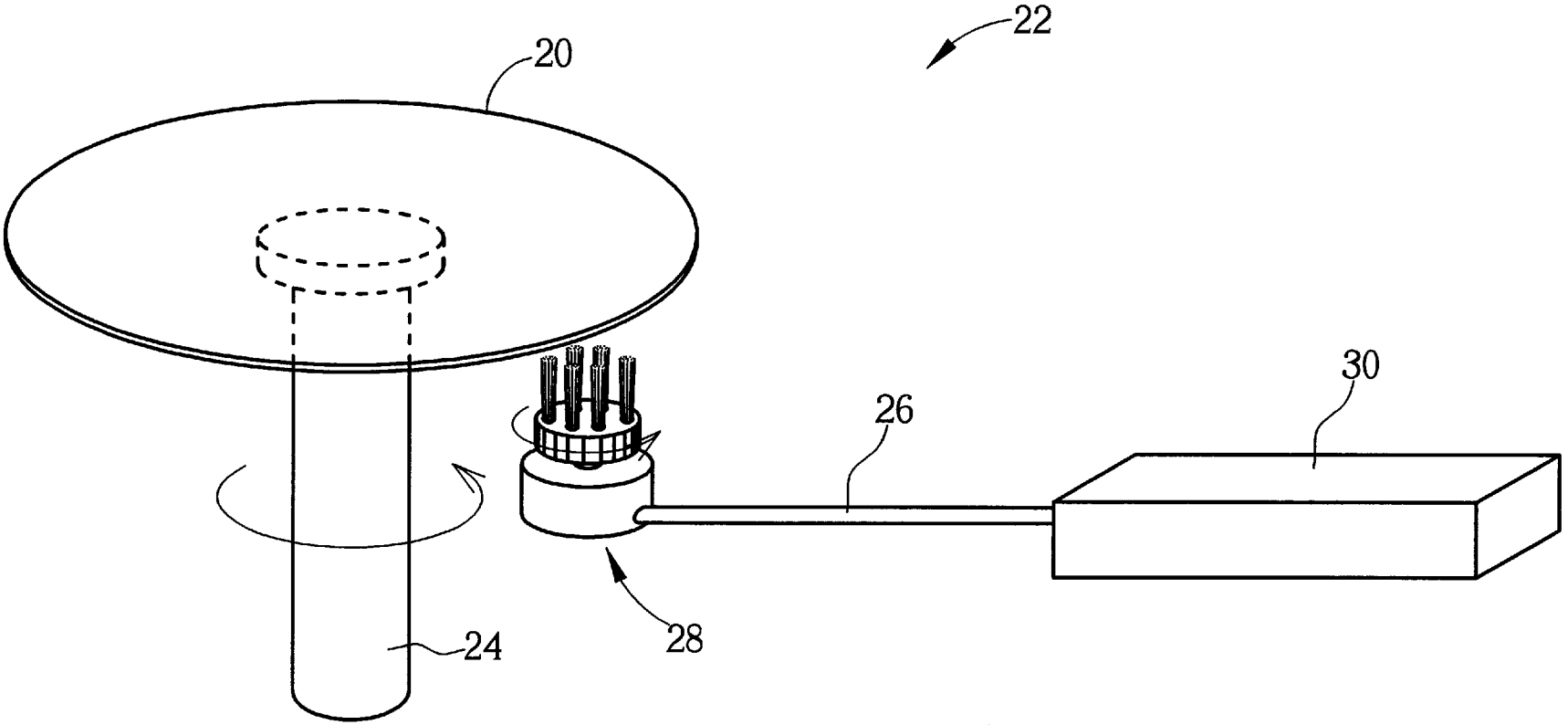
FIG. 2 is a schematic diagram of equipment for brushing the underside of a semiconductor wafer according to the present invention.

Please refer to FIG. 2. FIG. 2 is a schematic diagram of equipment 22 for brushing the underside of a semiconductor wafer according to the present invention. The equipment 22 for brushing the underside of a semiconductor wafer 20 comprises a rotary wafer chuck 24, a brush rod 26, a brush module 28, and a driving device 30. The rotary wafer chuck 24 is used for positioning the semiconductor wafer 20. The brush module is mounted at an end point of the brush rod 26 for spraying the underside of the semiconductor wafer 20 with water. The driving device 30 is connected to the brush rod 26 for driving the brush 28 to brush the underside of the semiconductor wafer 20 along a radial direction of the semiconductor wafer 20.

Figure 3:
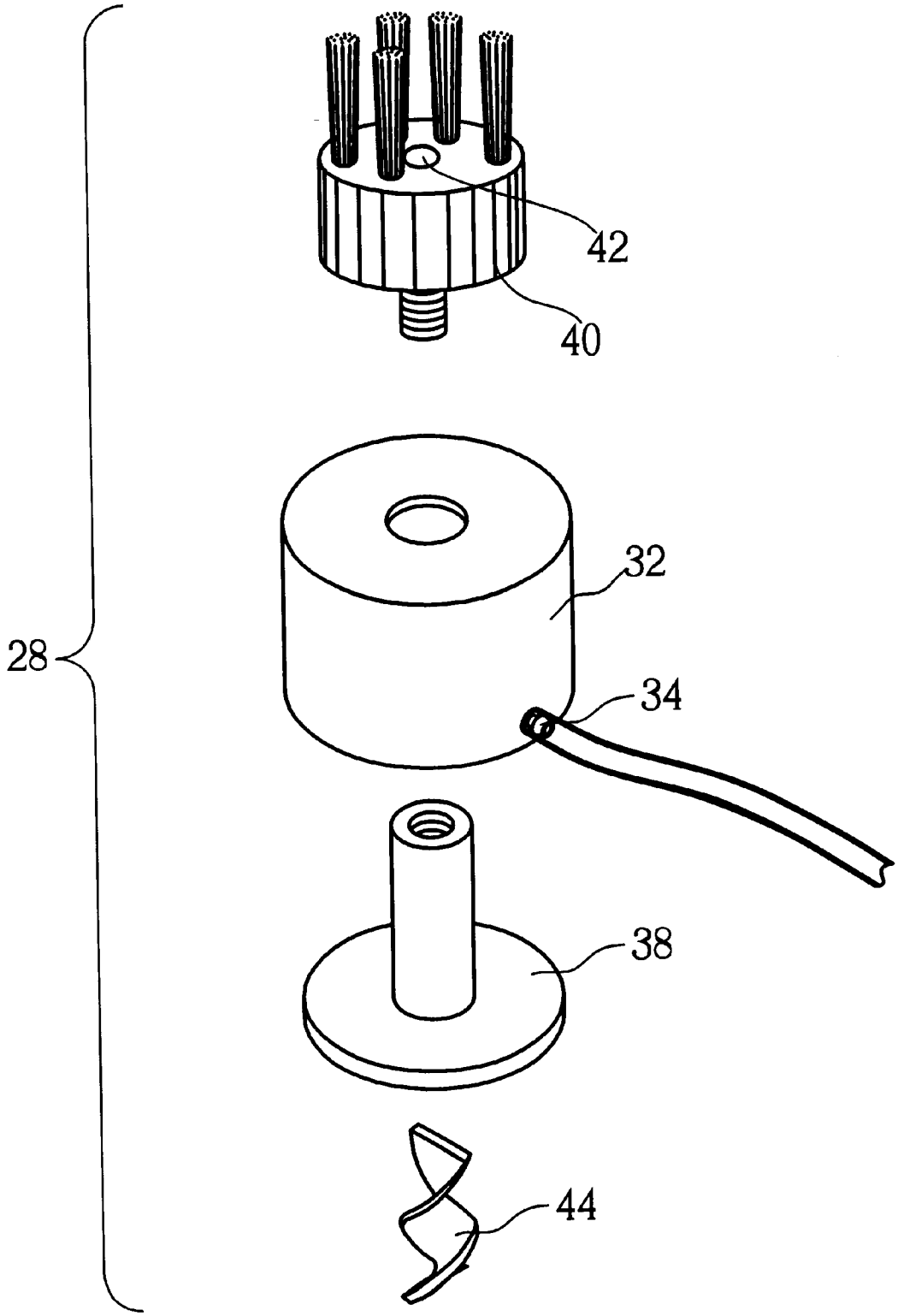
FIG. 3 is an exploded view of the brush module shown in FIG. 2.
Figure 4:
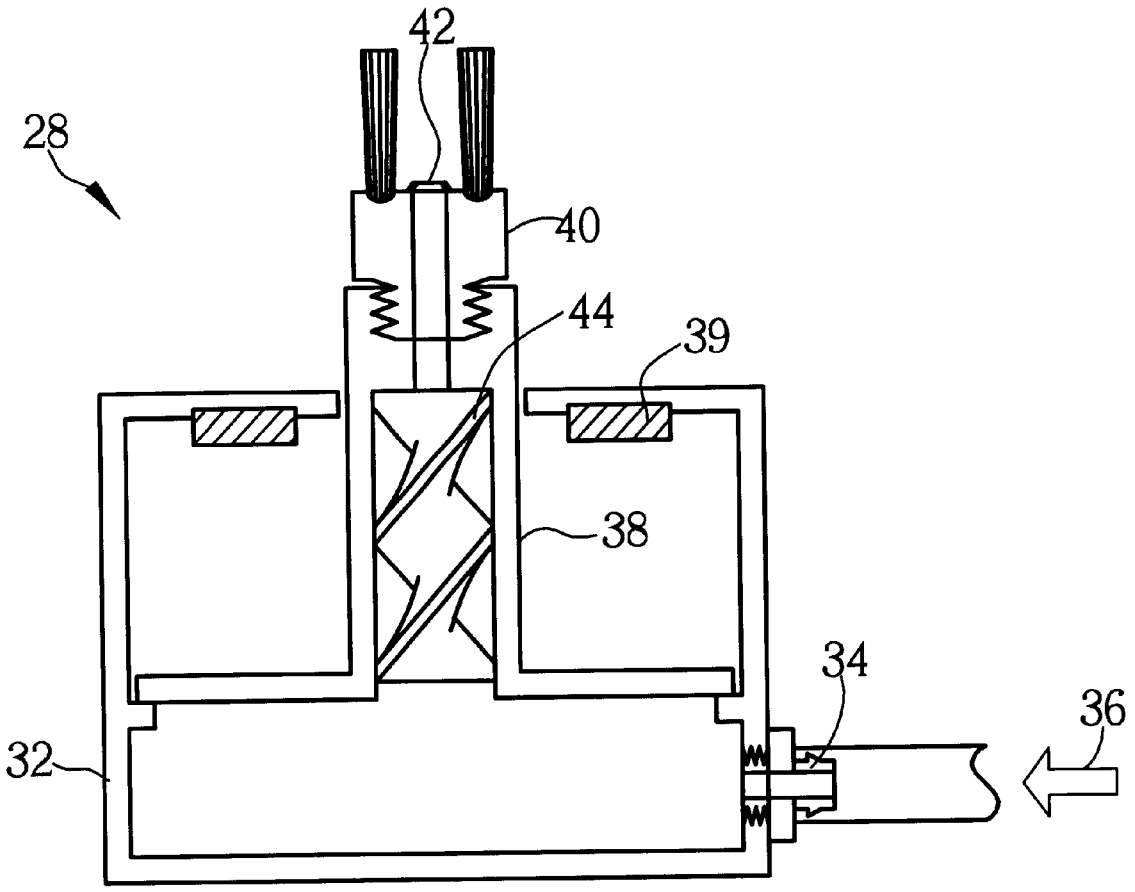
FIG. 4 is a sectional schematic diagram of the brush module shown in FIG. 2.
Figure 5:
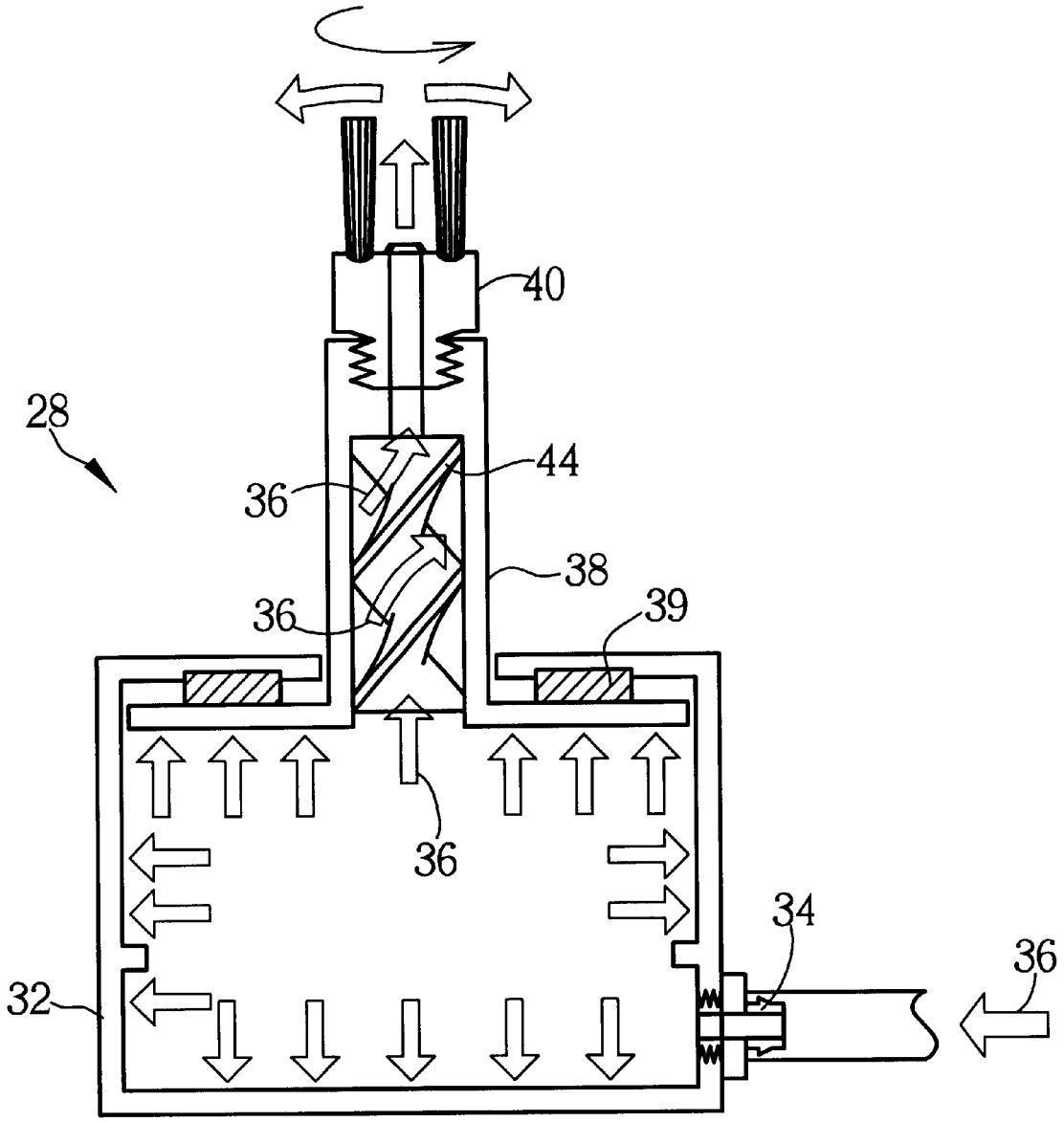
FIG. 5 is a sectional schematic diagram of the workings of the brush module shown in FIG. 4.

Please refer to FIG. 3 to FIG. 5. FIG. 3 is an exploded view of the brush module 28 shown in FIG. 2. FIG. 4 is a schematic diagram of the internal structure of the brush module 28 shown in FIG. 2. FIG. 5 is a sectional schematic diagram of the workings of the brush module 28 shown in FIG. 4. The brush module 28 of the equipment 22 comprises a base 32, an opening 34, a cylinder mechanism 38, a plastic pad 39, a brush 40 with a channel in it, a nozzle 42, and a blade 44. The opening 34 is positioned at the bottom of the base 32 for introducing water 36 into the base 32. The cylinder mechanism 38 is installed in the middle of the base 32 and is able to rise and descend. The plastic pad 39 is mounted on the upper internal surface of the base 32 and acts as a spacer between the cylinder mechanism 38 and the base 32 when the cylinder mechanism 38 is raised. The brush 40 with a channel in it is mounted on top of the cylinder mechanism 38. The nozzle 42 is mounted in the brush 40. The blade 44 is mounted inside the cylinder mechanism 38 and is rotatably connected to the brush 40.

When water 36 flows into the base 32, the cylinder mechanism 38 is raised and the blade 44 rotates the brush 40 as the water 36 flows through the blade 44. Then, the water 36 passes through the brush 40 and sprays from the nozzle 42 onto the underside of the semiconductor wafer 20. When the equipment 22 is employed to clean away developing solution from the underside of the semiconductor wafer 20, the water 36 sprayed from the nozzle 42 also washes away any developing solution on the brush 40. Hence, it is unlikely for any developing solution to remain on the brush 40. This avoids the underside of the semiconductor wafer 20 from again being contaminated by any developing solution on the brush 40.

Figure 6:
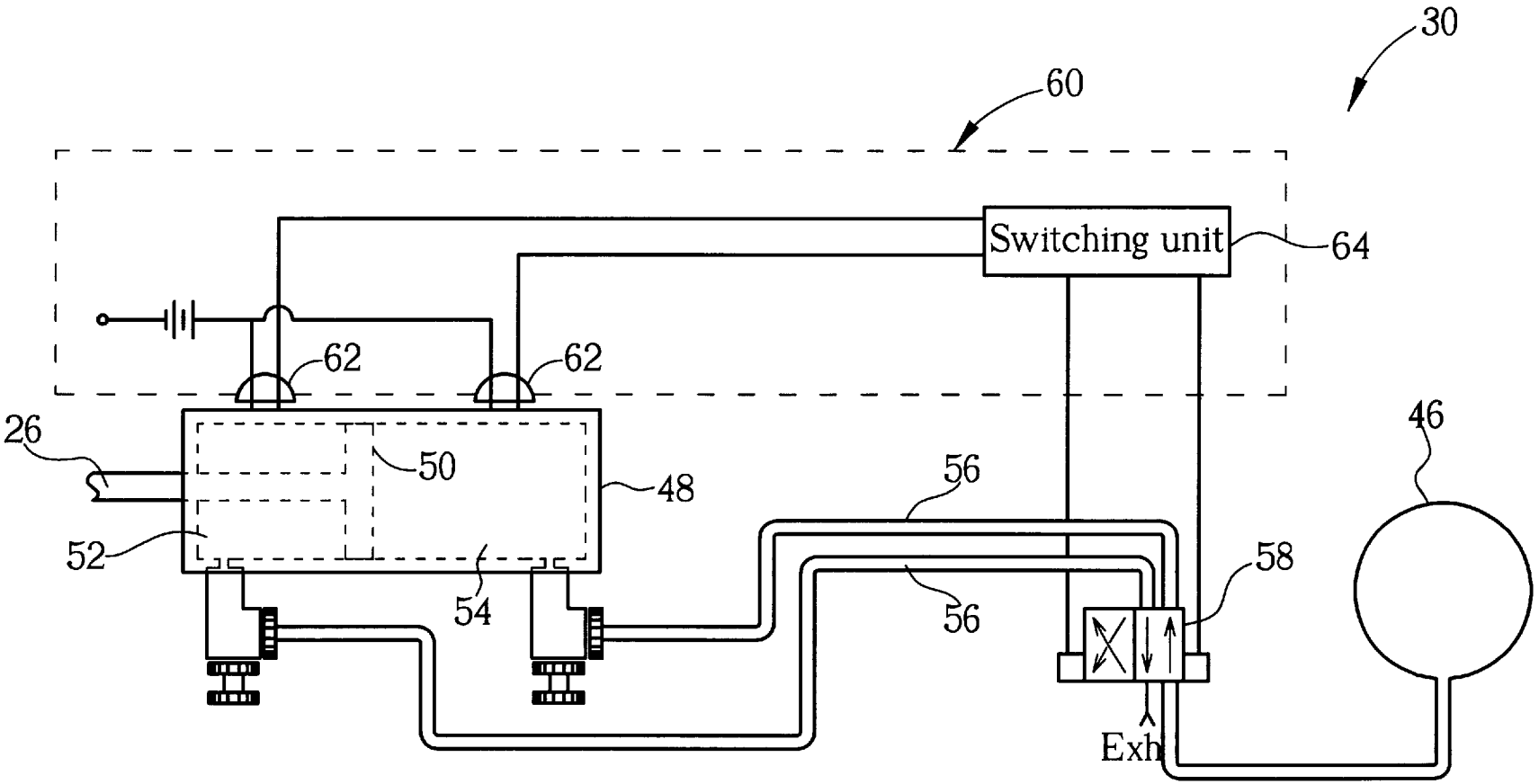
FIG. 6 is a schematic diagram of the driving device shown in FIG. 2.

Please refer to FIG. 6. FIG. 6 is a schematic diagram of the driving device 30 shown in FIG. 2. The driving device 30 comprises a high-pressure gas source 46, a cylinder 48, two gas tubes 56, a gas-controlling valve 58, and an electrical feedback controlling unit 60. The high-pressure gas source 46 is used to supply high-pressure gas (not shown). The cylinder 48 comprises a piston 50, which separates the cylinder 48 into a first chamber 52 and a second chamber 54. The two gas tubes 56 are separately connected to the first chamber 52 and the second chamber 54 for delivering the high-pressure gas into their respective chambers. The gas-controlling valve 58 is connected between the high-pressure gas source 46 and the gas tubes 56 to control the injecting and releasing of gas into the cylinder 48. The electrical feedback controlling unit 60 is connected to the gas-controlling valve 58 for switching the gas-controlling valve 58 according to a fixed period so as to periodically change the gas-injecting direction and the gas-releasing direction in the cylinder 48.

The electrical feedback controlling unit 60 comprises two sensors 62 and a switching unit 64. The two sensors 62 are separately installed close to opposite end points of the cylinder 48. The switching unit 64 is electrically connected to the two sensors 62 and the gas-controlling valve 58. The brush rod 26 is connected to the piston 50 by passing through the first chamber 52. Hence, the piston 50 drives the brush module 28 to in a reciprocating motion in the fixed time period.

When the gas-controlling valve 58 injects the high-pressure gas into the second chamber 54 and releases the gas from the first chamber 52, the high-pressure gas moves the piston 50 towards the first chamber 52. When the piston 50 is moved to the end point of the cylinder 48, the sensor 62 closest to the piston 50 will generate a relative signal that is transferred to the switching unit 64. The switching unit 64 then switches the gas-injection direction and the gas-releasing direction in the gas-controlling valve 58 according to the signal transferred from the sensor 62. This will cause the gas-controlling valve 58 to inject the high-pressure gas into the first chamber 52 and releases the gas from the second chamber 54. The high-pressure gas will then move the piston 50 towards the second chamber 54. When the piston 50 is moved to the other end point of the cylinder 48, the sensor 62 closest to the piston 50 will generate another relative signal to change the gas-injection direction and the gas-releasing direction in the gas-controlling valve 58. As the above-mentioned steps are repeated, the driving device 30 drives the brush rod 26 in a reciprocating motion to brush along the radial direction of the semiconductor wafer 20.

Figure 7:
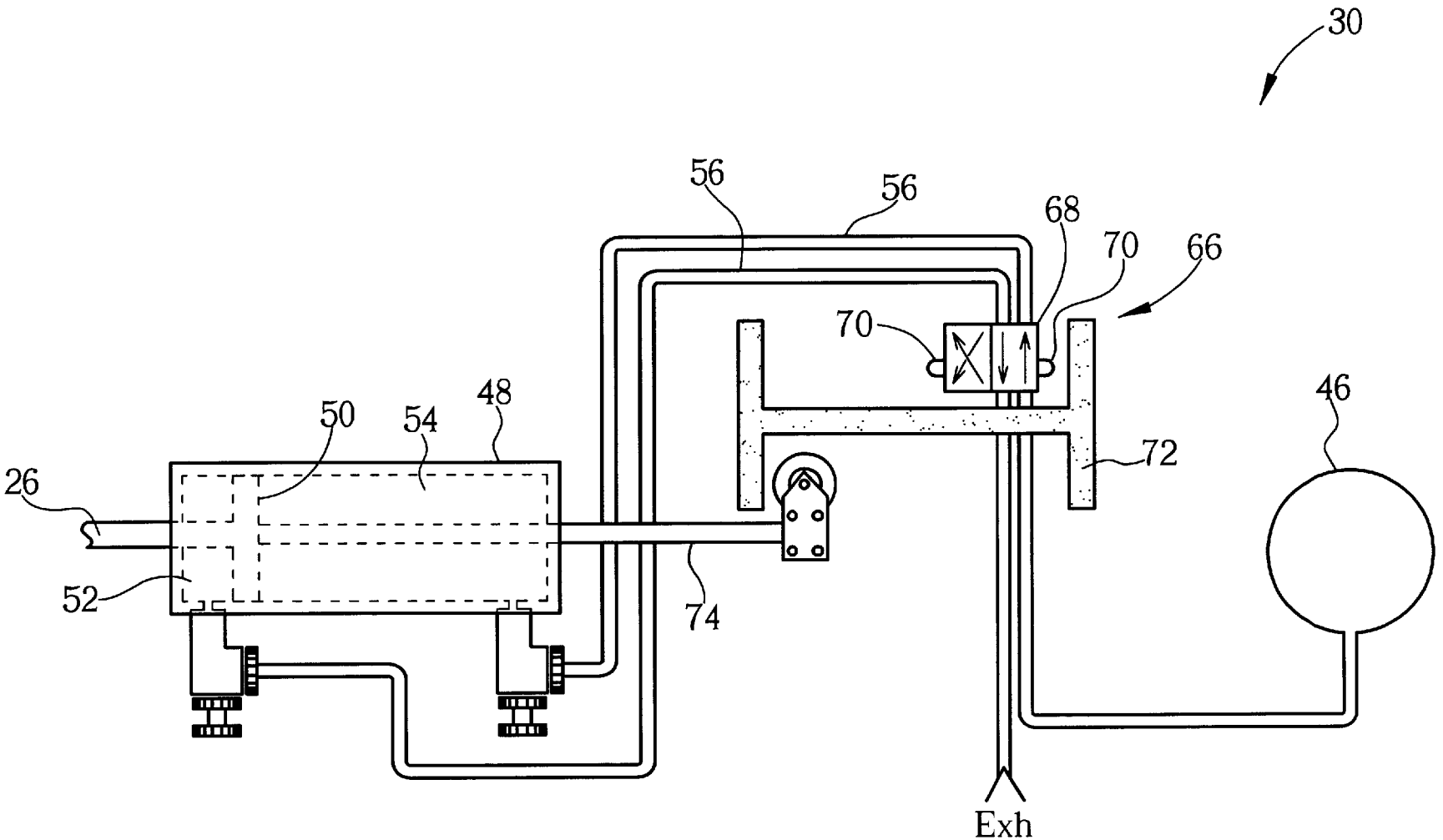
FIG. 7 is a schematic diagram of the driving device shown in FIG. 2 according to another embodiment of the present invention.

Please refer to FIG. 7. FIG. 7 is a schematic diagram of the driving device 30 shown in FIG. 2 according to another embodiment of the present invention. The driving device 30 of another embodiment of the present invention is formed by replacing the electrical feedback controlling unit 60 shown in FIG. 5 with a mechanical feedback controlling unit 66 and replacing the gas-controlling valve 58 shown in FIG. 5 with a trigger gas-controlling valve 68. The trigger gas-controlling valve 68 comprises two trigger switches 70 separately installed on a left side and a right side of the trigger gas-controlling valve 68. The mechanical feedback controlling unit 66 comprises an H-shaped mechanism 72 and an L-shaped shaft 74. The H-shaped mechanism 72 is placed along the direction of motion of the piston 50 in the equipment 22. The L-shaped shaft 74 is connected to the piston 50 by passing through the second chamber 54. The bottom of the L-shaped shaft 74 is installed in an opening between the two parallel arms of the H-shaped mechanism 72.

When the trigger gas-controlling valve 68 injects the high-pressure gas into the second chamber 54 and releases the gas from the first chamber 52, the high-pressure gas moves the piston 50 towards the first chamber 52. As the piston 50 is moved, the L-shaped shaft 74 is moved by the piston 50 so as to drive the H-shaped mechanism 72. When the piston 50 is moved to the end point of the cylinder 48, the H-shaped mechanism 72 can come into contact with its associated trigger switch 70 mounted on one side of the trigger gas-controlling valve 68 and thereby switch the gas injecting direction and the gas-releasing direction in the trigger gas-controlling valve 68. This will cause the trigger gas-controlling valve 68 to inject the high-pressure gas into the first chamber 52 and release the gas from the second chamber 54. The high-pressure gas will then move the piston 50 towards the second chamber 54. When the piston 50 moves to the opposite end point of the cylinder 48, the H-shaped mechanism 72 can come into contact with its other associated trigger switch 70 to switch the gas-injecting direction and the gas-releasing direction in the trigger gas-controlling valve 68. As the above-mentioned steps are repeated, the driving device 30 drives the brush rod 26 in a reciprocating motion to brush along the radial direction of the semiconductor wafer 20.

Compared to the prior art of equipment 12 for brushing the underside of the semiconductor wafer 10, the equipment 22 of the present invention comprises the brush for brushing the underside of the semiconductor wafer 20, so the developing solution that is not washed off by water is brushed away. In brushing the underside of the semiconductor wafer 20, the equipment 22 rotates the semiconductor wafer 20 and the driving device drives the brush to brush along the radial direction of the semiconductor wafer 20. Hence, the contaminated areas on the underside of the semiconductor wafer 20 are cleaned. Also, the brush module controls the raising and descending of the brush, so water sprayed from the channel in the brush causes the brush to rotate, which improves the cleaning effect.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An equipment for brushing an underside of a semiconductor wafer, the semiconductor wafer placed on a rotary wafer chuck, the equipment comprising:

a brush rod;

a brush mounted at an end point of the brush rod and a blade mounted axially under the brush, which are both simultaneously rotated by water when water flows through the blade, and which are raised by driving the brush when water flows through the brush and the blade, and which descend in conjunction with a reduced water pressure when water stops flowing;

a nozzle for spraying water on the underside of the semiconductor wafer; and a driving device connected to the brush rod for driving the brush rod in a reciprocating motion;

wherein when the wafer chuck rotates the semiconductor wafer, the nozzle sprays water on the underside of the semiconductor wafer and the driving device drives the brush to brush the underside of the semiconductor wafer along a radial direction of the semiconductor wafer.

2. The equipment of claim 1 wherein the nozzle is mounted on the brush.

3. The equipment of claim 2 wherein the brush contains a water channel in it for supplying water to the nozzle.

4. The equipment of claim 1 wherein the brush mounted at the end point of the brush rod is able to rise and descend.

5. The equipment of claim 1 wherein the driving device comprises:

a high-pressure gas source for providing a high-pressure gas;

a cylinder comprising a piston which separates the cylinder into a first chamber and a second chamber;

two gas tubes separately connected to the first chamber and the second chamber for delivering the gas into the first chamber and the second chamber;

a gas-controlling valve connecting the high-pressure gas source and the gas tubes for controlling injecting and releasing of the gas in the cylinder; when the gas-controlling valve injects the high-pressure gas into the second chamber and releases the gas from the first chamber, the high-pressure gas moves the piston towards the first chamber; when the gas-controlling valve injects the high-pressure gas into the first chamber and releases the gas from the second chamber, the high-pressure gas moves the piston towards the second chamber; and a controlling unit connected to the gas-controlling valve for switching the gas-controlling valve according to a fixed period so as to periodically change the gas-injecting direction and the gas-releasing direction in the cylinder;

wherein the brush rod is connected to the piston by passing through the first chamber, and the piston will drive the brush to move in reciprocating motion in the fixed period.

6. The equipment of claim 5 wherein the controlling unit is an electrical feedback controlling unit which comprises:

two sensors separately installed close to two end points of the cylinder; when the piston is moved to the end point of the cylinder, the sensor close to the piston will generate a relative signal; and a switching unit electrically connected to the two sensors and the gas-controlling valve for switching the gas-injecting direction and the gas-releasing direction in the gas-controlling valve according to the signal transferred from the sensor.

7. The equipment of claim 5 wherein the controlling unit is a mechanical feedback controlling unit, and the gas-controlling valve is a trigger gas-controlling valve which comprises two trigger switches separately installed at a left side and a right side of the trigger gas-controlling valve; the mechanical feedback controlling unit comprising:

an H-shaped mechanism placed along the direction of motion of the piston in the equipment; and an L-shaped shaft connected to the piston by passing through the second chamber, the bottom of the L-shaped shaft being installed in an opening between the two parallel arms of the H-shaped mechanism; the L-shaped shaft being moved by the piston so as to drive the H-shaped mechanism;

wherein the trigger gas-controlling valve is installed in another opening between the two parallel arms of the H-shaped mechanism and each of the parallel arms of the H-shaped mechanism can come into contact with its associated trigger switch mounted on one side of the trigger gas-controlling valve to switch the gas-injecting direction and the gas-releasing direction in the trigger gas-controlling valve when the piston moves to the end point of the cylinder.

8. The equipment of claim 1 wherein the equipment is used in a development process for cleaning and removing chemical liquids which flow to the underside of the semiconductor wafer during the development process.

9. An equipment for brushing an underside of a semiconductor wafer, the equipment comprising:

a rotary wafer chuck for positioning the semiconductor wafer;

a brush rod;

a brush module mounted at an end point of the brush rod for spraying the underside of the semiconductor wafer with water, the brush module comprising a base, an opening positioned at a bottom of the base for introducing water into the base, a cylinder mechanism installed in a middle of the base and being raised by water when water flows into the base, a brush with a channel mounted on top of the cylinder mechanism, a nozzle mounted on the brush for spraying water from the channel of the brush onto the underside of the semiconductor wafer, and a blade mounted inside the cylinder mechanism, is the blade rotated together with the brush when water flows through the blade; and a driving device connected to the brush rod for driving the brush rod to in a reciprocating motion;

wherein when the wafer chuck rotates the semiconductor wafer, the brush module sprays the underside of the semiconductor wafer with water and the driving device drives the brush module to brush the underside of the semiconductor wafer along a radial direction of the semiconductor wafer.

10. The equipment of claim 9 wherein the driving device comprises:

a high-pressure gas source for providing a high-pressure gas;

a cylinder comprising a piston which separates the cylinder into a first chamber and a second chamber;

two gas tubes separately connected to the first chamber and the second chamber for delivering the gas into the first chamber and the second chamber;

a gas-controlling valve connecting the high-pressure gas source and the gas tubes for controlling injecting and releasing of the gas in the cylinder; when the gas-controlling valve injects the high-pressure gas into the second chamber and releases the gas from the first chamber, the high-pressure gas moves the piston towards the first chamber; when the gas-controlling valve injects the high-pressure gas into the first chamber and releases the gas from the second chamber, the high-pressure gas moves the piston towards the second chamber; and a controlling unit connected to the gas-controlling valve for switching the gas-controlling valve according to a fixed period so as to periodically change the gas-injecting direction and the gas-releasing direction in the cylinder;

wherein the brush rod is connected to the piston by passing through the first chamber, and the piston will drive the brush to move in reciprocating motion in the fixed period.

11. The equipment of claim 10 wherein the controlling unit is an electrical feedback controlling unit which comprises:

two sensors separately installed close to two end points of the cylinder; when the piston is moved to the end point of the cylinder, the sensor close to the piston will generate a relative signal; and a switching unit electrically connected to the two sensors and the gas-controlling valve for switching the gas-injecting direction and the gas-releasing direction in the gas-controlling valve according to the signal transferred from the sensor.

12. The equipment of claim 10 wherein the controlling unit is a mechanical feedback controlling unit, and the gas-controlling valve is a trigger gas-controlling valve which comprises two trigger switches separately installed on a left side and a right side of the trigger gas-controlling valve; the mechanical feedback controlling unit comprising:

an H-shaped mechanism placed along the direction of motion of the piston in the equipment; and an L-shaped shaft connected to the piston by passing through the second chamber, the bottom of the L-shaped shaft being installed in an opening between the two parallel arms of the H-shaped mechanism; the L-shaped shaft being moved by the piston so as to drive the H-shaped mechanism;

wherein the trigger gas-controlling valve is installed in another opening between the two parallel arms of the H-shaped mechanism and each of the parallel arms of the H-shaped mechanism can come into contact with its associated trigger switch mounted on one side of the trigger gas-controlling valve to switch the gas-injecting direction and the gas-releasing direction in the trigger gas-controlling valve when the piston moves to the end point of the cylinder.

* * * * *